US010975670B2

(12) United States Patent
Jones

(10) Patent No.: US 10,975,670 B2
(45) Date of Patent: Apr. 13, 2021

(54) PERFORATING GUN

(71) Applicant: Tenax Energy Solutions, LLC, Clinton, OK (US)

(72) Inventor: Kevin Dewayne Jones, Clinton, OK (US)

(73) Assignee: Tenax Energy Solutions, LLC, Clinton, OK (US)

( * ) Notice: Subject to any disclaimer, the term of this patent is extended or adjusted under 35 U.S.C. 154(b) by 0 days.

(21) Appl. No.: 16/594,784

(22) Filed: Oct. 7, 2019

(65) Prior Publication Data

US 2020/0109614 A1 Apr. 9, 2020

Related U.S. Application Data

(60) Provisional application No. 62/742,072, filed on Oct. 5, 2018.

(51) Int. Cl.

| | |
|---|---|
| ***E21B 43/117*** | (2006.01) |
| ***E21B 47/06*** | (2012.01) |
| ***E21B 47/09*** | (2012.01) |
| ***E21B 47/07*** | (2012.01) |

(52) U.S. Cl.

CPC ..... *E21B 43/117* (2013.01); *E21B 47/06* (2013.01); *E21B 47/07* (2020.05); *E21B 47/09* (2013.01)

(58) Field of Classification Search

CPC .... E21B 43/11; E21B 43/116; E21B 17/1078; E21B 43/117; E21B 47/07; E21B 47/06; E21B 47/09

See application file for complete search history.

(56) References Cited

U.S. PATENT DOCUMENTS

| | | | | |
|---|---|---|---|---|
| 10,082,008 | B2 | 9/2018 | Robey et al. | |
| 2002/0189802 | A1* | 12/2002 | Tolman | E21B 43/117 166/55 |
| 2011/0017453 | A1* | 1/2011 | Mytopher | E21B 43/117 166/298 |
| 2013/0062055 | A1* | 3/2013 | Tolman | E21B 43/119 166/250.01 |
| 2015/0096752 | A1 | 4/2015 | Burgos et al. | |

(Continued)

FOREIGN PATENT DOCUMENTS

| | | | |
|---|---|---|---|
| AU | 2012300262 | B2 | 7/2017 |
| CA | 2951814 | A1 | 4/2013 |

(Continued)

OTHER PUBLICATIONS

Hunting "NAPS North America Perforating Symposium", symposium, 2018, 17 pages, 2018-NAPS-22, Galveston, USA.

*Primary Examiner* — Tara Schimpf
*Assistant Examiner* — Dany E Akakpo
(74) *Attorney, Agent, or Firm* — Tomlinson McKinstry, P.C.

(57) ABSTRACT

A perforating gun for use in oil and gas operations. The gun is carried to a desired area of a wellbore using only fluid pressure. The gun comprises a charge housing disposed within a removable sleeve. The charge housing comprises a plurality of shaped charges in communication with one or more sensors. The sensors are programmed to initiate the detonation sequence of the shaped charges upon measuring set parameters. Upon detonation, the gun fragments into a plurality of pieces that may be washed away from the detonation site.

5 Claims, 17 Drawing Sheets

(56) References Cited

U.S. PATENT DOCUMENTS

| | | | | |
|---|---|---|---|---|
| 2016/0115753 | A1 | 4/2016 | Frazier et al. | |
| 2018/0112500 | A1 | 4/2018 | Collins et al. | |
| 2020/0088013 | A1 * | 3/2020 | Grove | E21B 43/1195 |

FOREIGN PATENT DOCUMENTS

| | | | |
|---|---|---|---|
| EP | 2992178 | B1 | 2/2018 |
| EP | 3401499 | A1 | 11/2018 |
| EP | 3404199 | A1 | 11/2018 |
| WO | 2016168491 | A1 | 10/2016 |

* cited by examiner

PERFORATING GUN

SUMMARY

The present invention is directed to a kit comprising an elongate sleeve having a helical groove formed in its outer surface, and an elongate charge housing configured to be installed within the sleeve and comprising at least one sensor installed within the charge housing. The kit further comprises a plurality of explosive charges configured to be installed within the charge housing.

The present invention is also directed to a method of using a tool in an environment. The tool comprises an elongate body carrying a plurality of explosive charges. The elongate body is installed within a removable sleeve and a helical groove is formed in an outer surface of the sleeve. The environment comprises a wellbore formed within the ground and having a casing installed therein. The wellbore comprises a horizontal section. The method comprises the steps of lowering the tool into the horizontal section of the wellbore using only fluid pressure.

DETAILED DESCRIPTION

Figure 1:
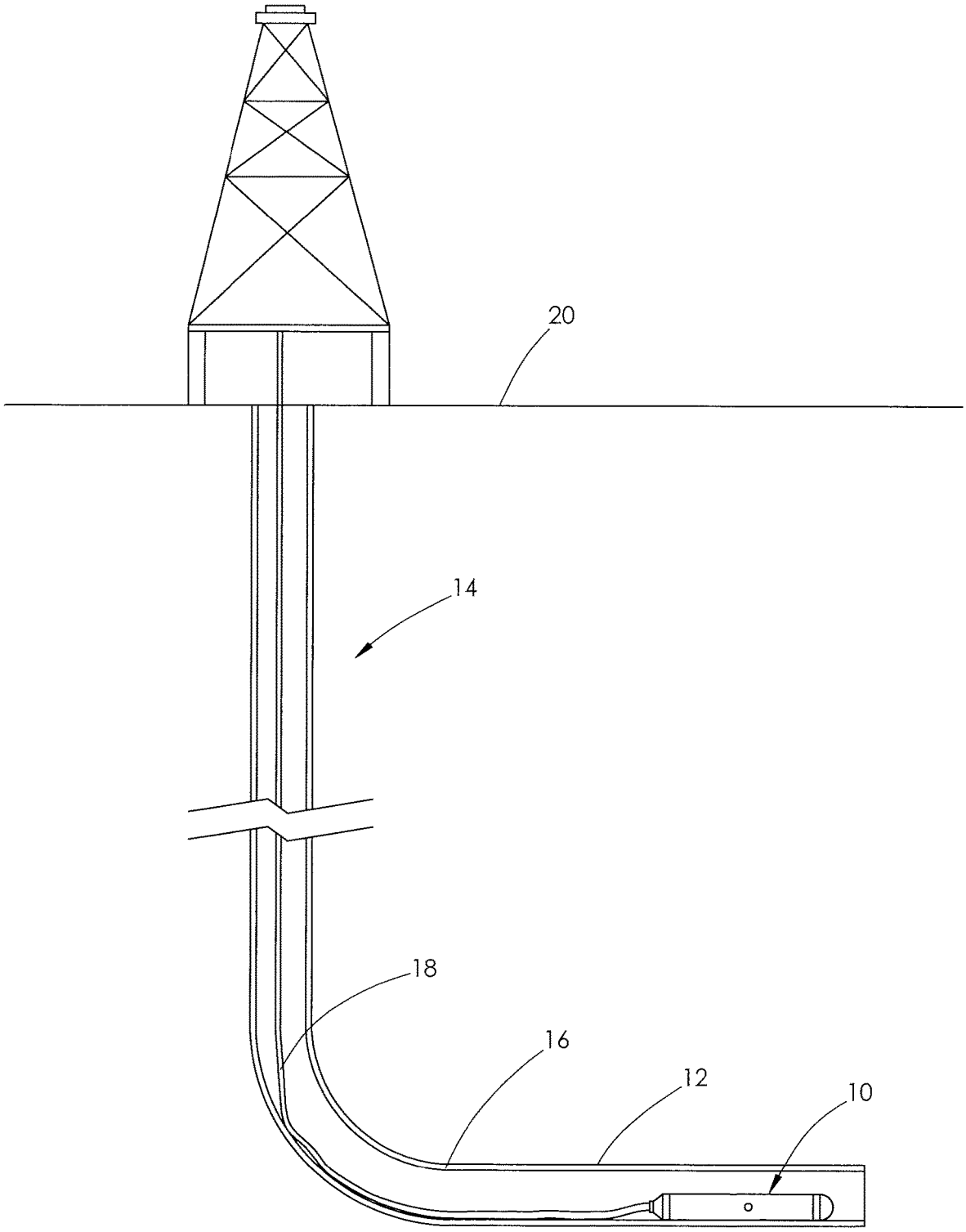
FIG. 1 is an illustration of a cased wellbore formed during an oil and gas operation. A perforating gun known in the art is positioned within a horizontal section of the wellbore and is attached to a wireline.

With reference to FIG. 1, a perforating gun 10 known in the art is shown positioned within a horizontal section 12 of a wellbore 14. Perforating guns, like that shown in FIG. 1, are used in fracking operations to perforate a casing 16 installed in the wellbore 14 and perforate the surrounding rock formations. The perforations are created by detonating charged explosives housed in the gun 10. The perforations act as conduits for fluid to flow from the rock formation and into the casing 16.

Perforating guns are typically lowered into a horizontal section of the wellbore by a wireline. The perforating gun 10 in FIG. 1 is shown attached to a wireline 18. The wireline 18 extends from the gun 10 to the ground surface 20 through the casing 16. While not shown, the wireline 18 is typically supported on a reel at the ground surface 20.

After the explosives contained within the gun to are detonated, the remains of the gun 10 are pulled to the ground surface 20 by the wireline 18. The remains of the gun 10 are removed from the wellbore 14 so as to not interfere with future downhole operations. Using a wireline to lower the tool into and withdraw the tool from the wellbore takes time. The wireline may also hang up on well debris as it moves. Freeing a stuck wireline takes even more time.

Turning to FIGS. 2-10, a perforating gun 22 is disclosed that can be lowered into a horizontal section of a wellbore without the use of a wireline. Rather, the gun 22 is carried into a horizontal section of a wellbore using only fluid flow. Once detonated, the gun 22 is configured to fragment into a plurality of pieces that may be washed away from the detonation site.

Figure 2:
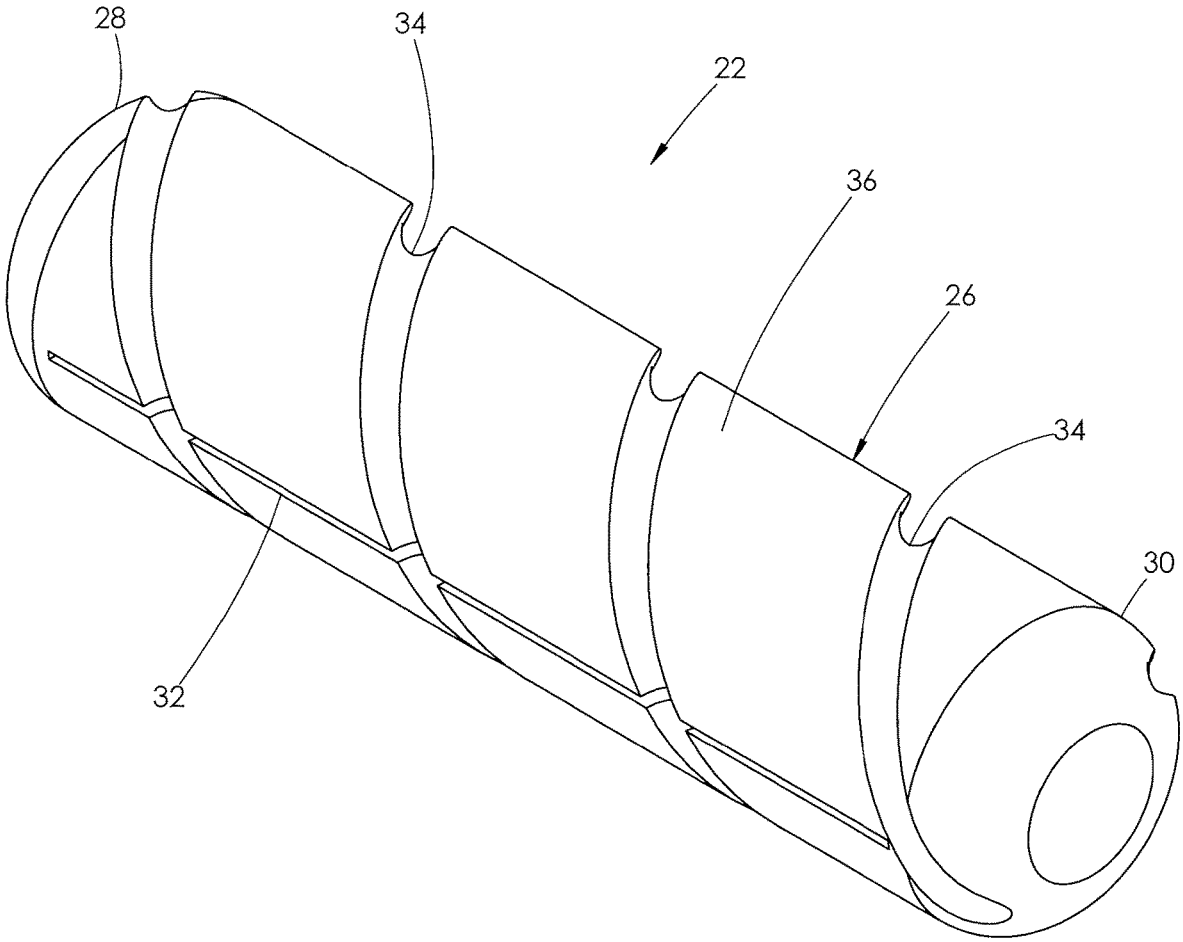
FIG. 2 is a perspective view of a perforating gun of the present disclosure.
Figure 3:
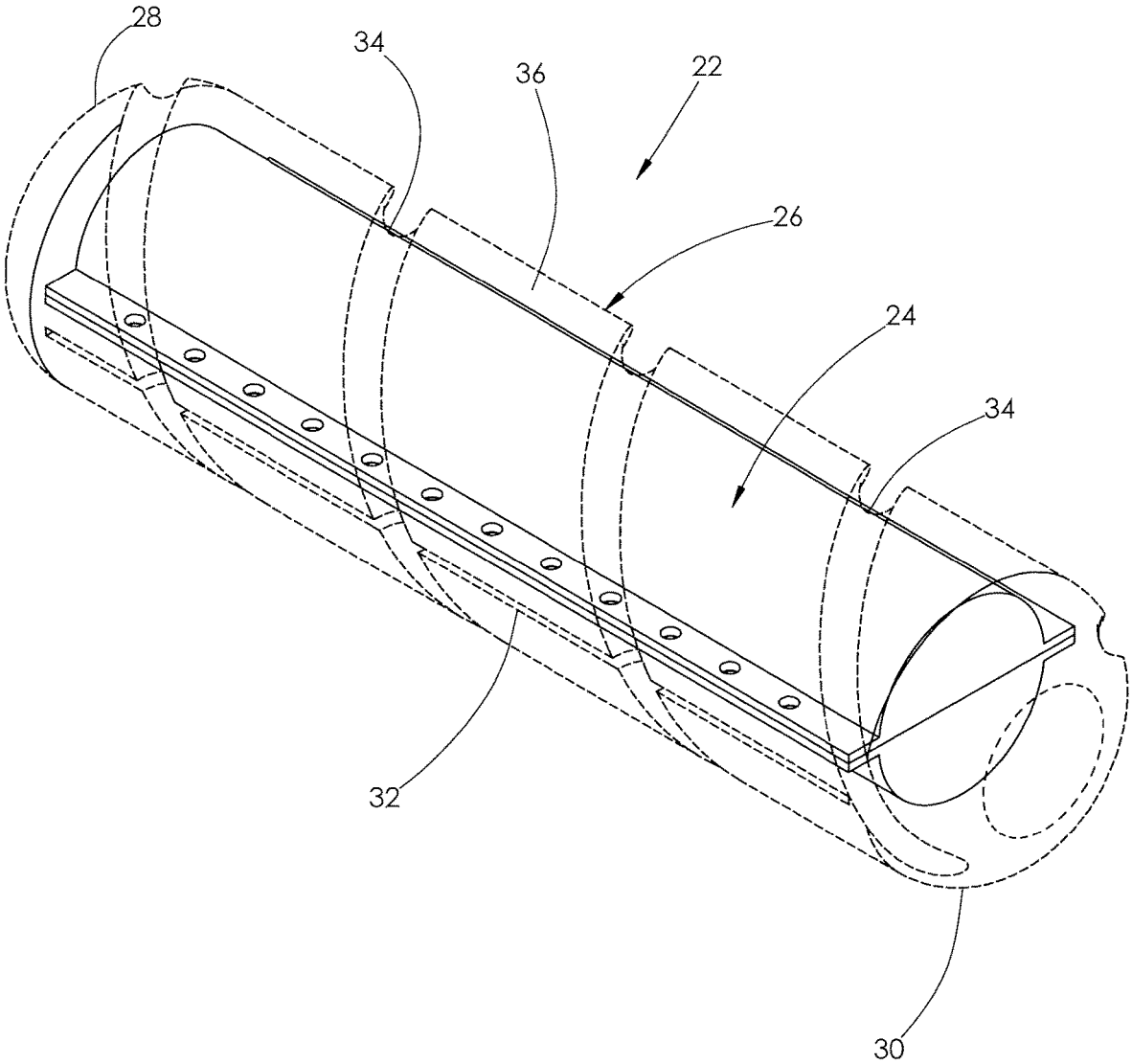
FIG. 3 is a perspective transparent view of the gun shown in FIG. 1. A charge housing is visible through the gun's outer sleeve.

Turning to FIGS. 2 and 3, the gun 22 comprises a charge housing 24, shown in FIG. 3, disposed within an outer sleeve 26. The sleeve 26 is preferably made of a dense foam material. Alternatively, the sleeve 26 may be made of any material capable of fragmenting during operation of the gun 22. The sleeve 26 has a hollow center and closed ends 28 and 30. A slit 32 is formed along a longitudinal axis of the sleeve 26, as shown in FIG. 2. The charge housing 24 is installed within the sleeve 26 through the slit 32. When installed, the sleeve 26 fits tightly around the charge housing 24. The slit 32 may be taped or fastened closed once the charge housing 24 is installed.

A helical groove 34 is formed in an outer surface 36 of the sleeve 26 and extends between the ends 28 and 30. The groove 34 provides a flow path for fluid around the gun 22. Fluid flowing within the groove 34 helps limit the fluid pressure differential between opposing ends 28 and 30 of the gun 22 as the gun 22 is lowered down the casing 16. Limiting the pressure differential between the ends 28 and 30 helps protect the sleeve 26 from being deformed by fluid pressure prior to detonation of the gun 22. Fluid flowing within the groove 34 also causes the gun 22 to rotate as it is carried down the casing 16. The rotation helps overcome any static friction between the gun 22 and the casing 16 as the gun 22 is lowered into the horizontal section 12 of the wellbore 14.

Figure 4:
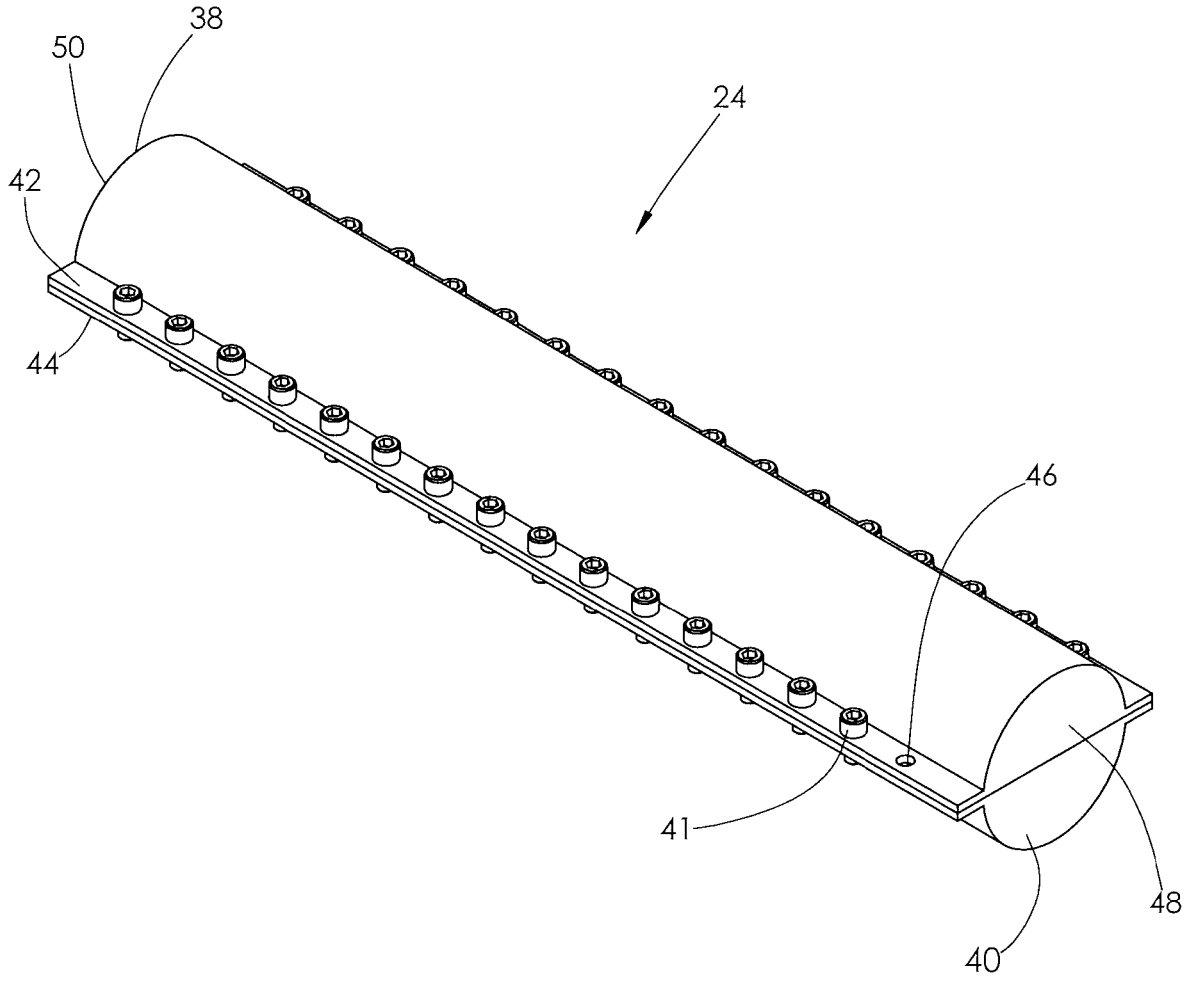
FIG. 4 is a perspective view of the charge housing shown in FIG. 3
Figure 5:
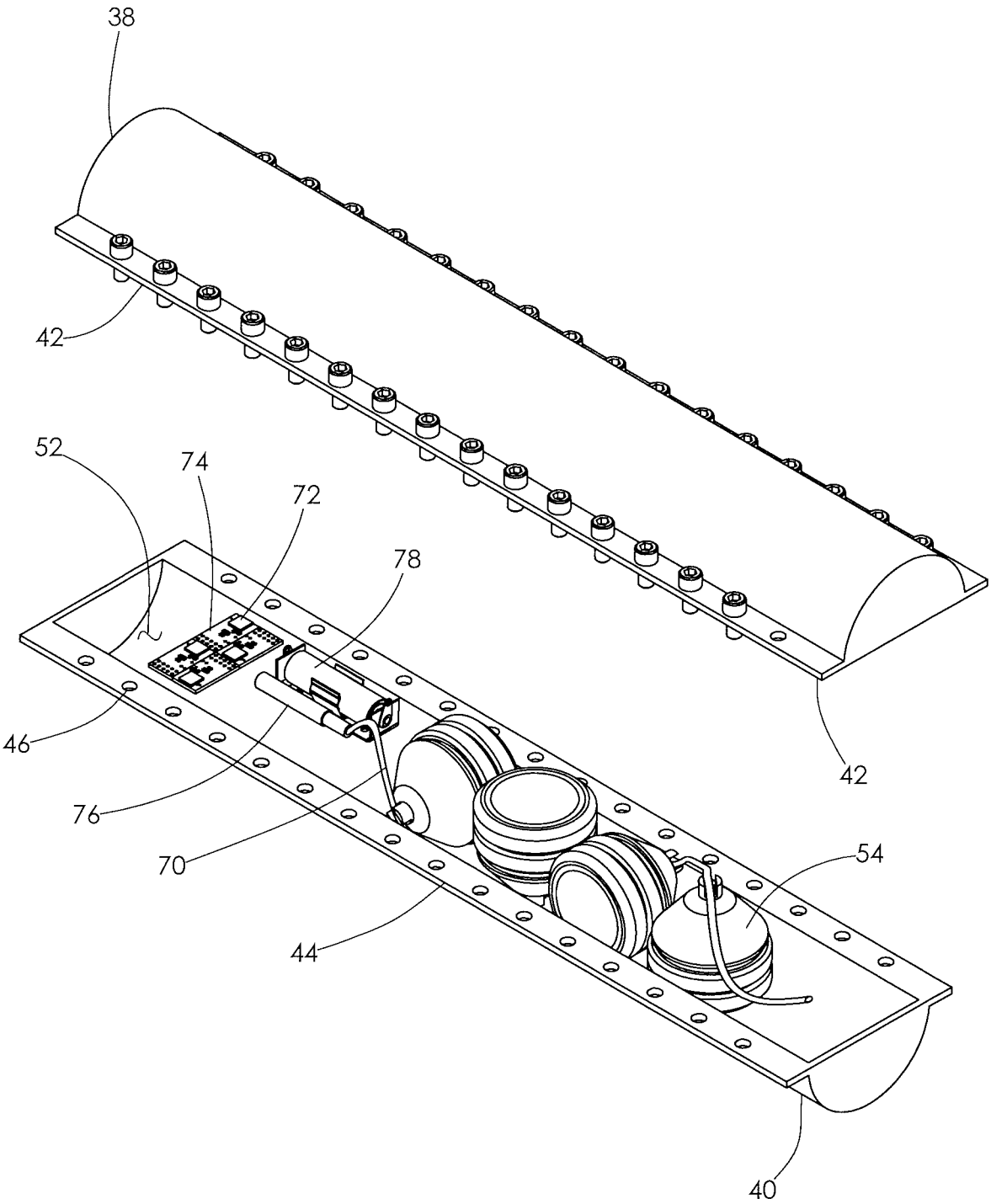
FIG. 5 is a partially exploded view of the charge housing shown in FIG. 4.
Figure 6:
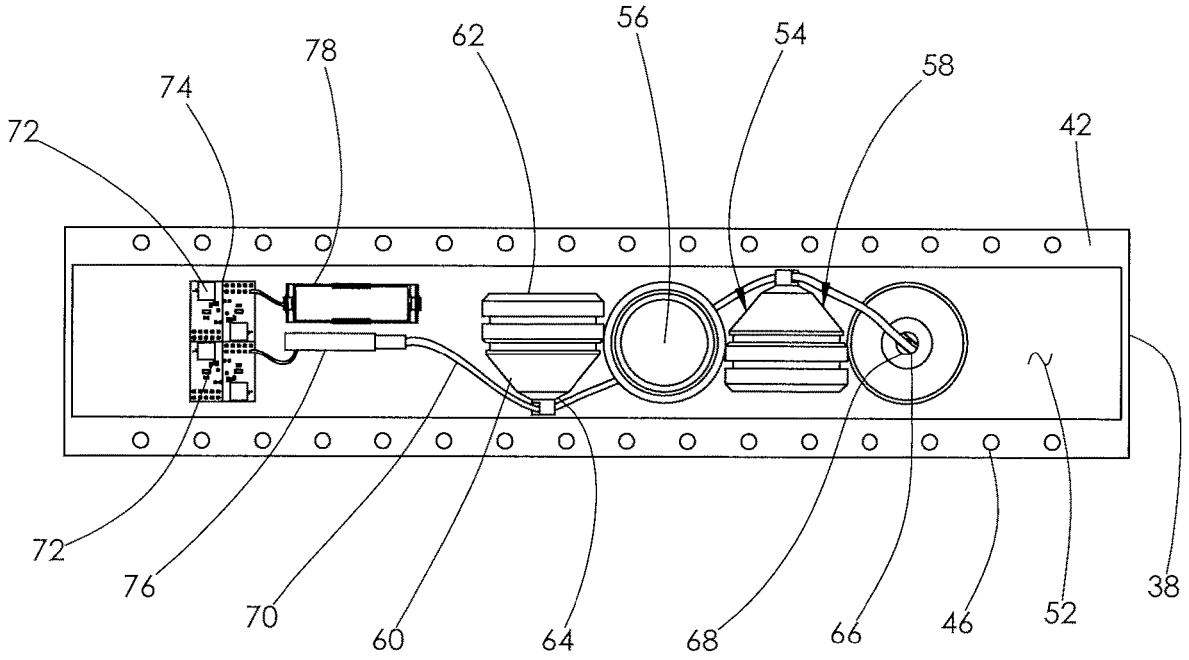
FIG. 6 is a sectional view of the charge housing shown in FIG. 4, exposing the inner components.

With reference to FIGS. 4-6, the charge housing 24 comprises a first half 38 joined to a second half 40 by a plurality of fasteners 41, as shown in FIG. 4. The halves 38 and 40 are sectioned along a longitudinal axis of the charge housing 24. Each half 38 and 40 has a set of lips 42 and 44 that project from and extend along each of its opposed outer edges. A plurality of openings 46 are formed along the length of each set of lips 42 and 44. When the halves 38 and 40 are joined together, the opposing lips 42 and 44 mate with one another. The fasteners 41 are subsequently installed within the openings 46 in order to hold the halves 38 and 40 together. When the halves 38 and 40 are joined, the charge housing 24 has closed ends 48 and 50 and a central cavity 52. The charge housing 24 is preferably made of a ceramic or other non-metallic solid material.

Continuing with FIGS. 5 and 6, a plurality of shaped charges 54 are housed within the central cavity 52 of the charge housing 24. Each of the shaped charges 54 comprises a highly explosive material 56 packed into a funnel-shaped lens 58. The material 56, for example, may comprise titanium, potassium, and phosphorus mixed with glass. Each of the lenses 58 comprises a body 60 that tapers inwardly from an open top surface 62 to a closed base 64. Because the top surface 62 of the body 60 is open, the material 56 packed within the body 60 is exposed to the outside environment. A connection point 66 is formed on the base 64 and is characterized by a circular projection having a slot 68 formed therein. The bodies 60 and connection points 66 are preferably made of the same material as the charge housing 24.

The shaped charges 54 are installed within the central cavity 52 prior to joining the halves 38 and 40 together. When installed, each of the charges 54 faces a different direction. Such positioning allows the gun 22 to perforate multiple areas of the casing 16 when the charges 54 are detonated. When detonated, the charges 54 explode radially out of the charge housing 24 and fragment the housing 24 into a plurality of pieces.

Figure 11:
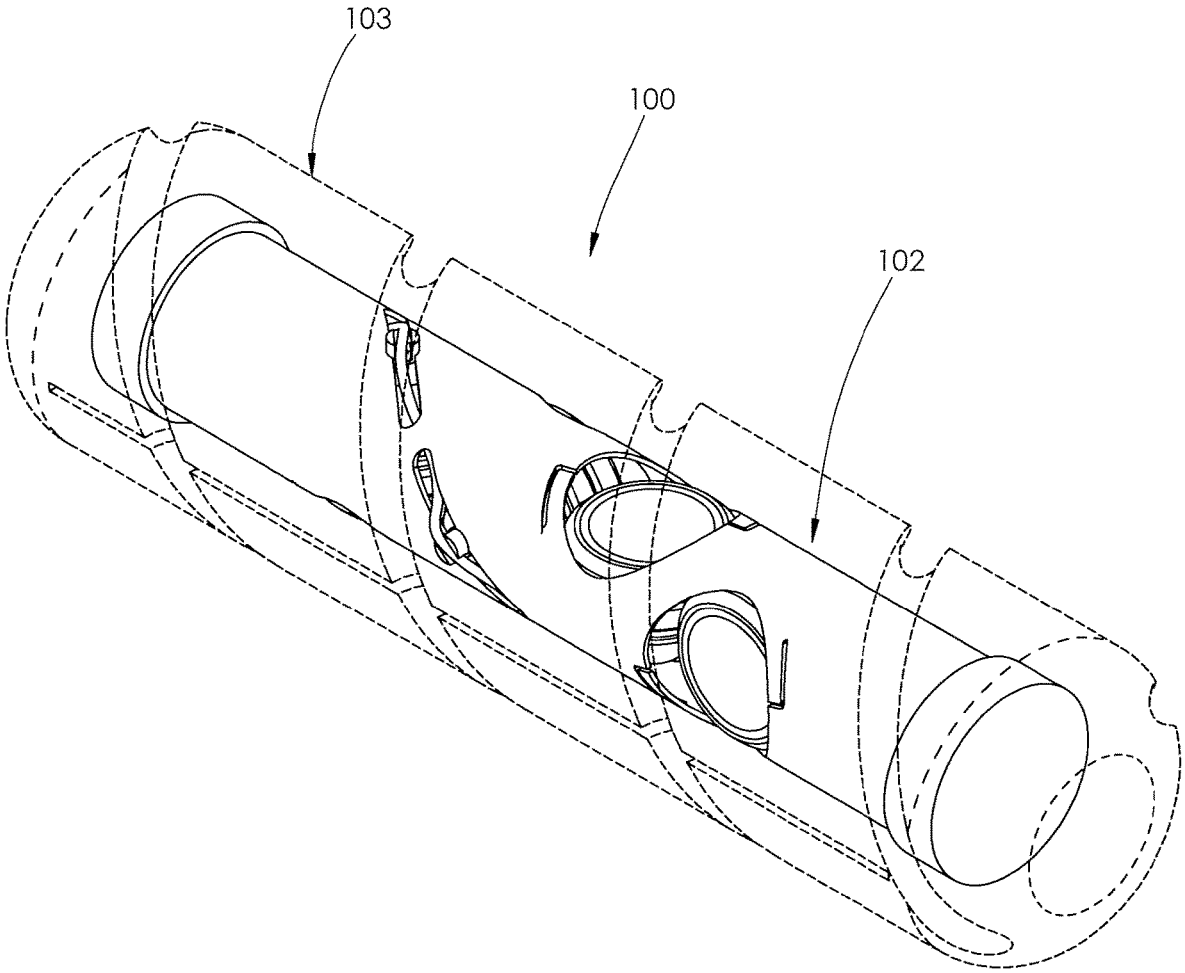
FIG. 11 is a perspective transparent view of a another embodiment of a perforating gun. Another embodiment of a charge housing is visible through the gun's outer sleeve.
Figure 16:
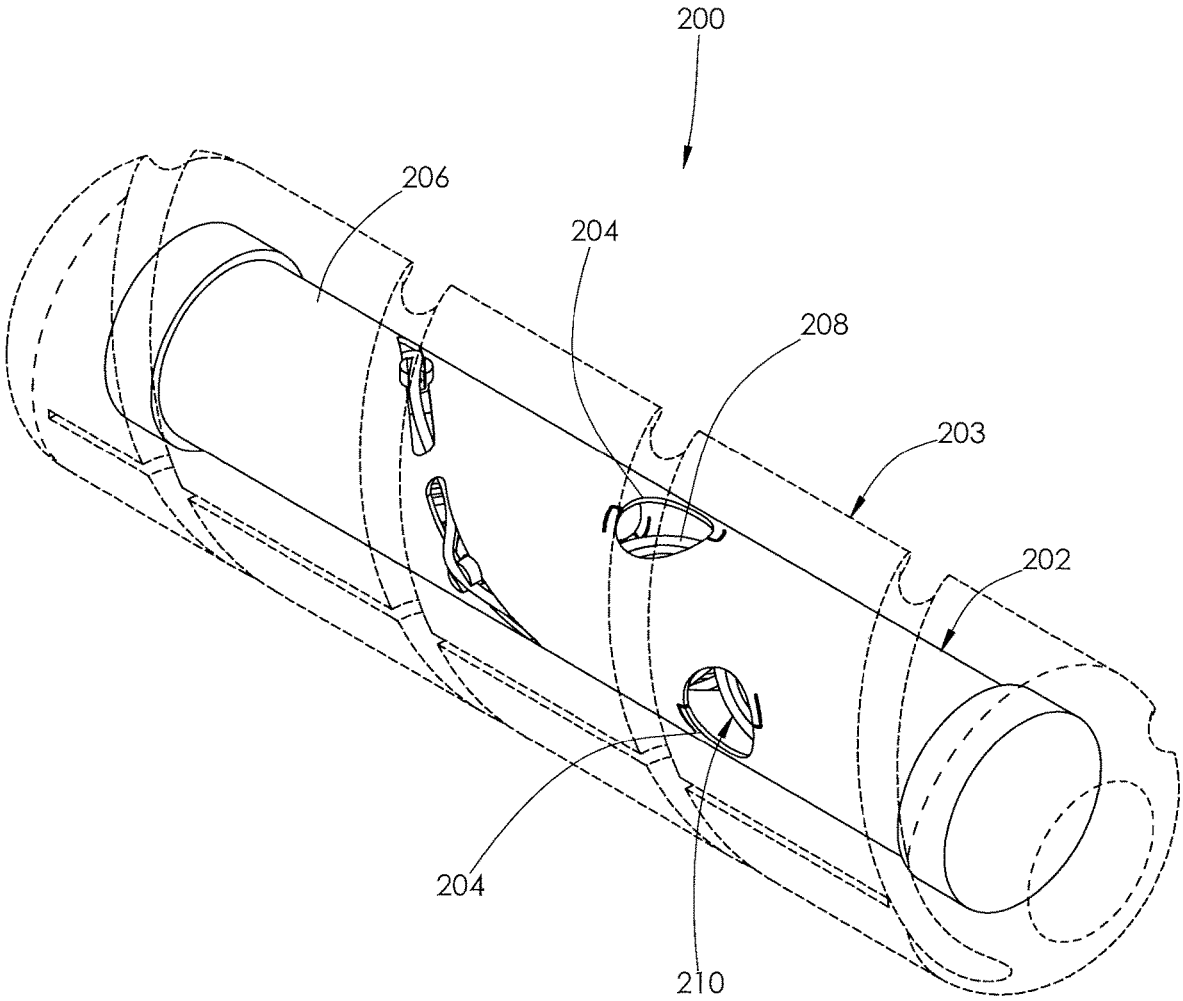
FIG. 16 is a perspective transparent view of an alternative embodiment of a perforating gun. Another embodiment of a charge housing is visible through the gun's outer sleeve.

In an alternative embodiment, the charge housing may comprise a plurality of openings that correspond with a top surface of each of the shaped charges, like those shown in FIG. 11 or 16. Such openings provide extra clearance for the charges upon detonation. However, the charges will still contact at least a portion of the charge housing upon detonation and fragment the housing into a plurality of pieces.

The embodiment of the charge housing 24 shown in FIGS. 4-6 includes four shaped charges 54. In alternative embodiments, the charge housing may include more or less than four charges. The charges may also be configured so that the shaped charges are positioned at any angle desired relative to one another.

Continuing with FIGS. 5 and 6, a detonation cord 70 is installed within the charge housing 24 and engages with each of the shaped charges 54. The cord 70 may comprise PETN wrapped in a tough textile or plastic. When installed, the cord 70 is positioned within each slot 68 formed in each of the connection points 66. Once ignited, the detonation cord 70 acts as a high-speed fuse and ignites each of the shaped charges 54. The shaped charges 54 each explode radially outward upon ignition by the cord 70.

One or more sensors 72 are supported on an electronic board 74 within the charge housing 24. The sensors 72 are electrically coupled to a detonator 76, which is attached to the detonation cord 70. A battery 78 connected to the electronic board 74 powers the one or more sensors 72 and the detonator 76. The one or more sensors 72 may comprise a collar counter, a temperature sensor, and/or a pressure sensor.

Figure 7:
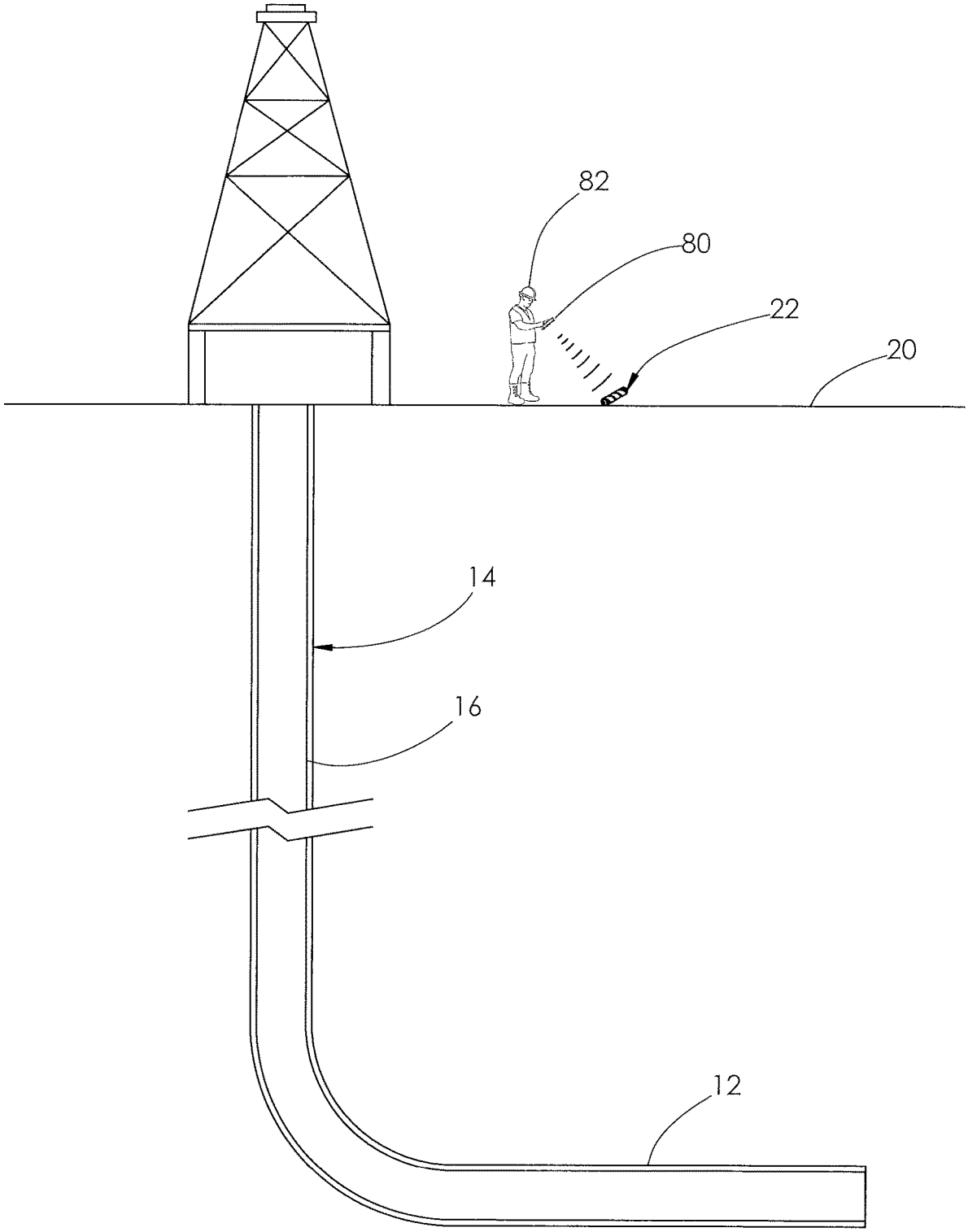
FIG. 7 is an illustration of a method of operating the gun shown in FIG. 1. An operator is positioned at the ground surface holding a display device and the gun has yet to be lowered into a cased wellbore.

Turning to FIG. 7, when the gun 22 is positioned at the ground surface 20, the one or more sensors 72 are configured to wirelessly communicate with a display device 80 prior to lowering the gun 22 into the wellbore 14. The display device 80 may be a tablet, smart phone, or computer. An operator 82 may designate set values for the one or more sensors 72 on the display device 80.

In operation, the sensors 72 may be configured to signal the detonator 76 to ignite the detonation cord 70 upon measuring the set values designated by the operator. For example, the collar counter may be set to count 800 collars before signaling the detonator 76. Alternatively, a pressure sensor may be set to measure 300 psi or a temperature sensor may be set to measure 150° F., before signaling the detonator 76. In some embodiments, set values for two or more of the sensors 72 must be met before the sensors 72 signal the detonator 76 to ignite the detonation cord 70.

Figure 8:
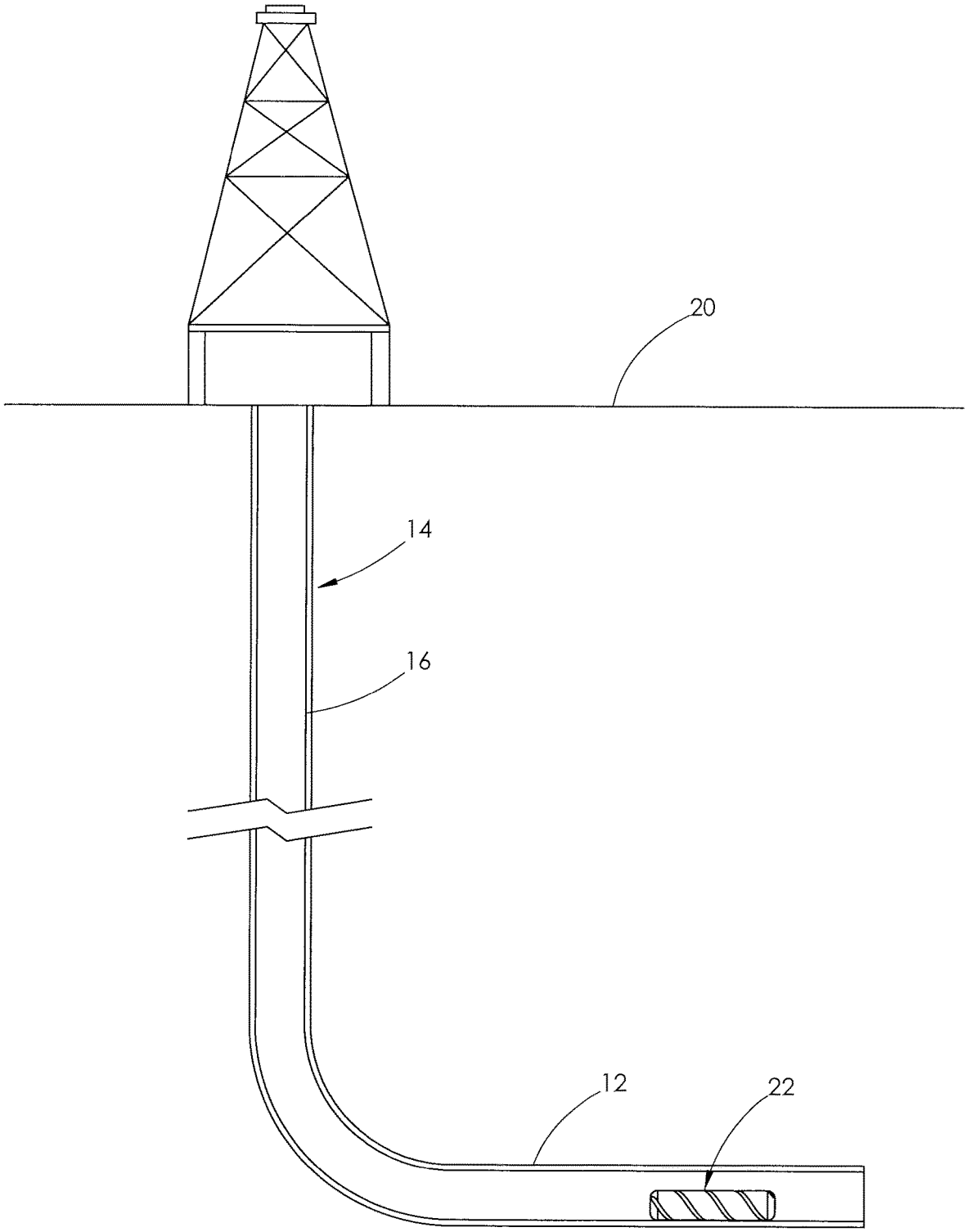
FIG. 8 is the same view as FIG. 7, but at a later stage of operation. The gun is shown positioned within a horizontal section of the wellbore.

With reference to FIGS. 2-10, in operation, the shaped charges 54 may be installed within the charge housing 24 at the well site. The assembled charge housing 24 is subsequently installed within the sleeve 26, as shown in FIG. 3. The one or more sensors 72 may be programmed before or after the charge housing 24 is installed within the sleeve 26. The programmed and assembled gun 22 is lowered into the casing 16 and carried by fluid to the horizontal section 12 of the wellbore 14, as shown in FIG. 8. Once the set values for the one or more sensors 72 are met, the one or more sensors 72 will signal the detonator 76 to ignite the detonation cord 70.

Figure 9:
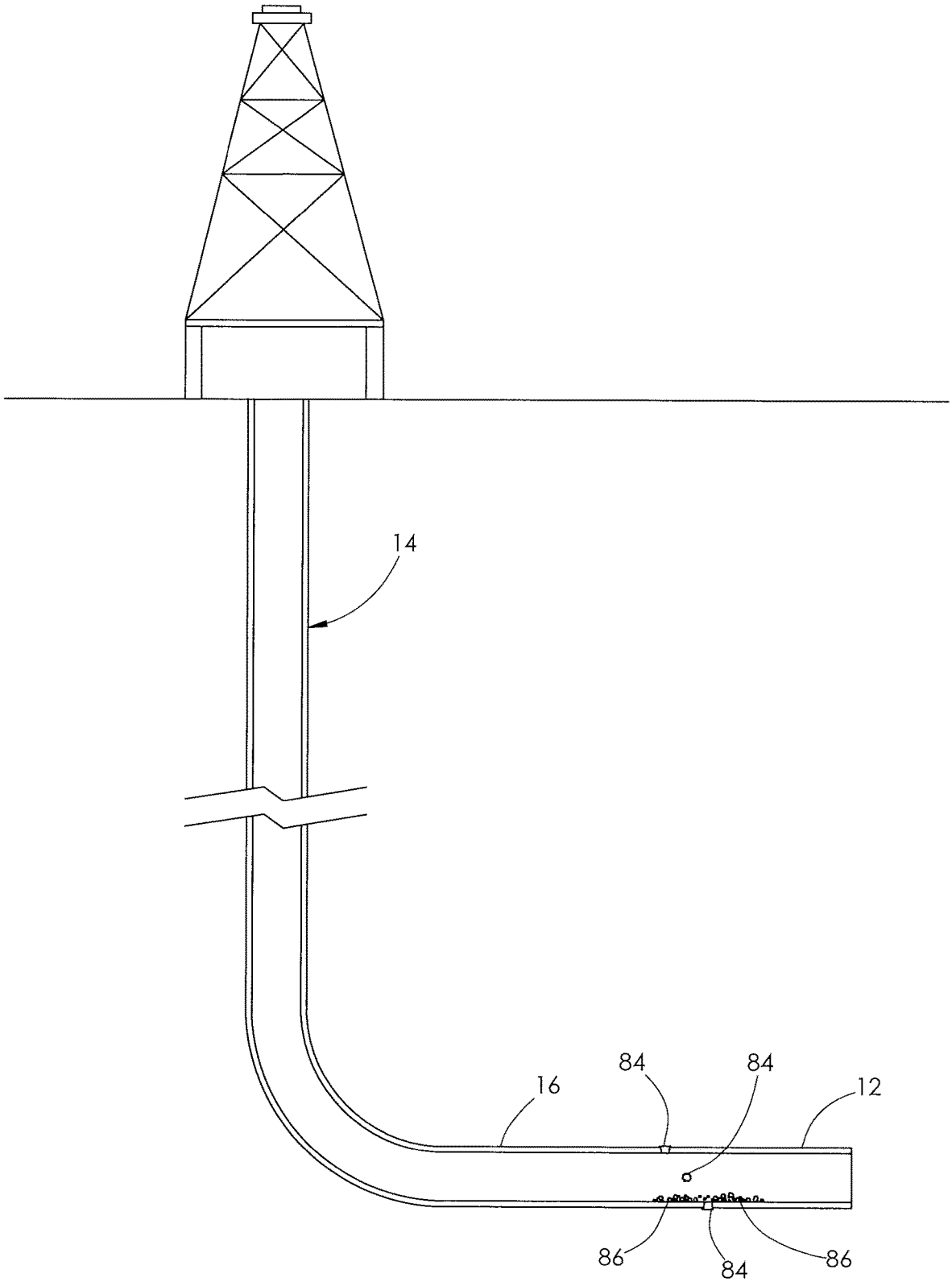
FIG. 9 is the same view as FIG. 8, but at a later stage of operation. The gun has detonated and fragmented into a plurality of pieces.
Figure 10:
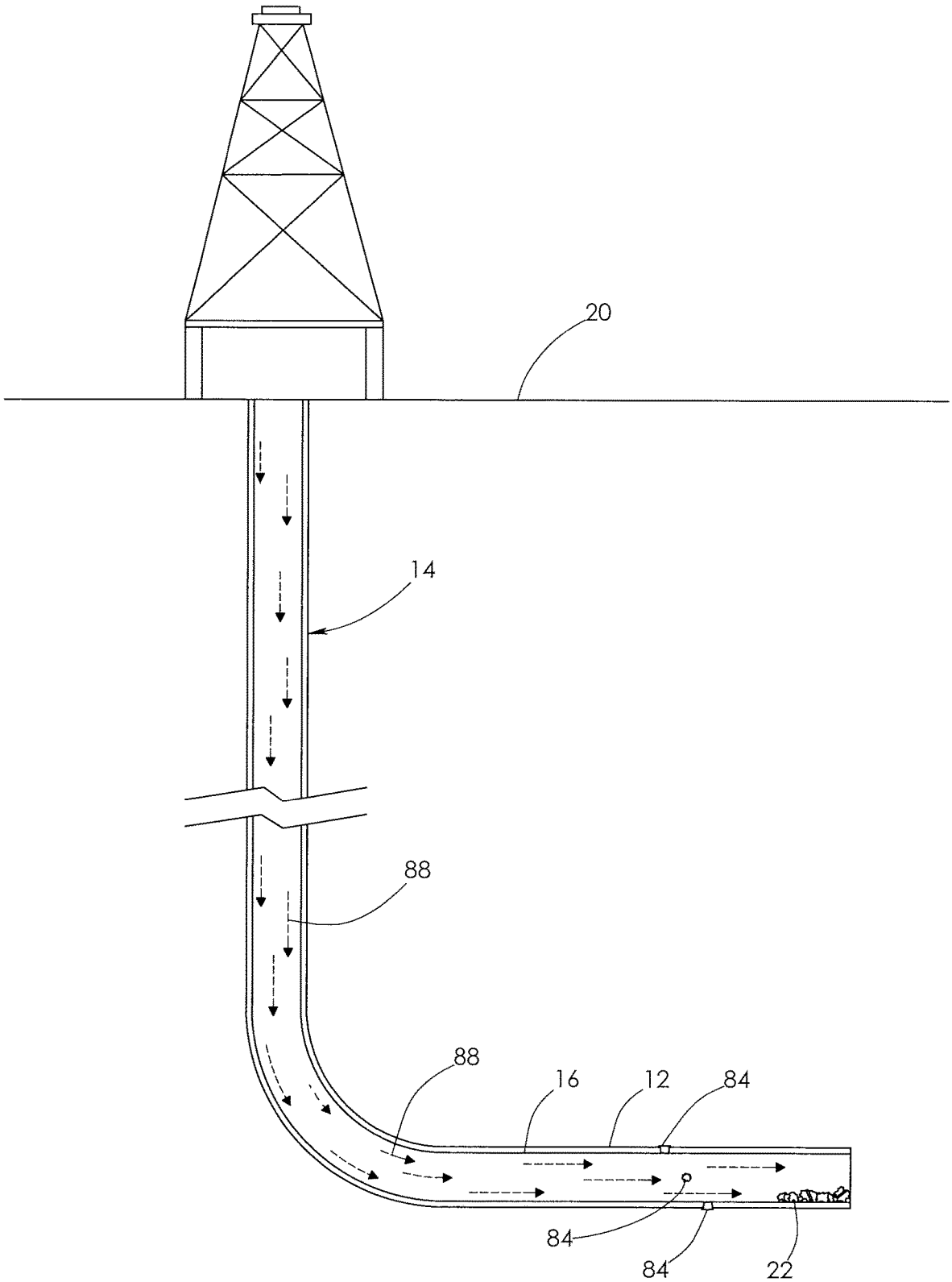
FIG. 10 to is the same view as FIG. 8, but at a later stage of operation. The gun has detonated and fragmented into a plurality of pieces, but the pieces are larger than those shown in FIG. 9.

The detonation cord 70 will rapidly ignite each of the shaped charges 54. Such ignition happens fast enough that the shaped charges 54 are virtually ignited simultaneously. Once ignited, the shaped charges 54 explode radially away from the gun 22 and create perforations 84 in the surrounding casing 16 and rock formation, as shown in FIG. 9. The explosion of the shaped charges 54 will fragment the gun 22 into a plurality of pieces 86, as shown in FIG. 9.

The explosion may not be enough to thoroughly fragment the gun 22 into the plurality of pieces 86 shown in FIG. 9. In such case, fluid pressure may be increased within the casing 16, as shown by arrows 88, in FIG. 10. The fluid impacting the gun 22 will cause the gun 22 to fragment into a plurality of pieces 86 shown in FIG. 9.

The plurality of pieces 86 of the gun 22 are subsequently flushed down the casing 16 and away from any further downhole operations. The pieces 86 may also be flushed through the open perforations 84 and into the surrounding rock formation. Thus, the gun 22 may be lowered into and removed from the wellbore 14 using only fluid.

If desired, the gun 22 may still be lowered into the horizontal section 12 of the wellbore 14 using the wireline 18 shown in FIG. 1. Any portion of the gun 22 still remaining and still attached to the wireline 18 after detonation will be removed from the wellbore 14 with the wireline 18. The gun 22 may also be programmed to detonate within the vertical section of the wellbore 14, if desired.

Figure 12:
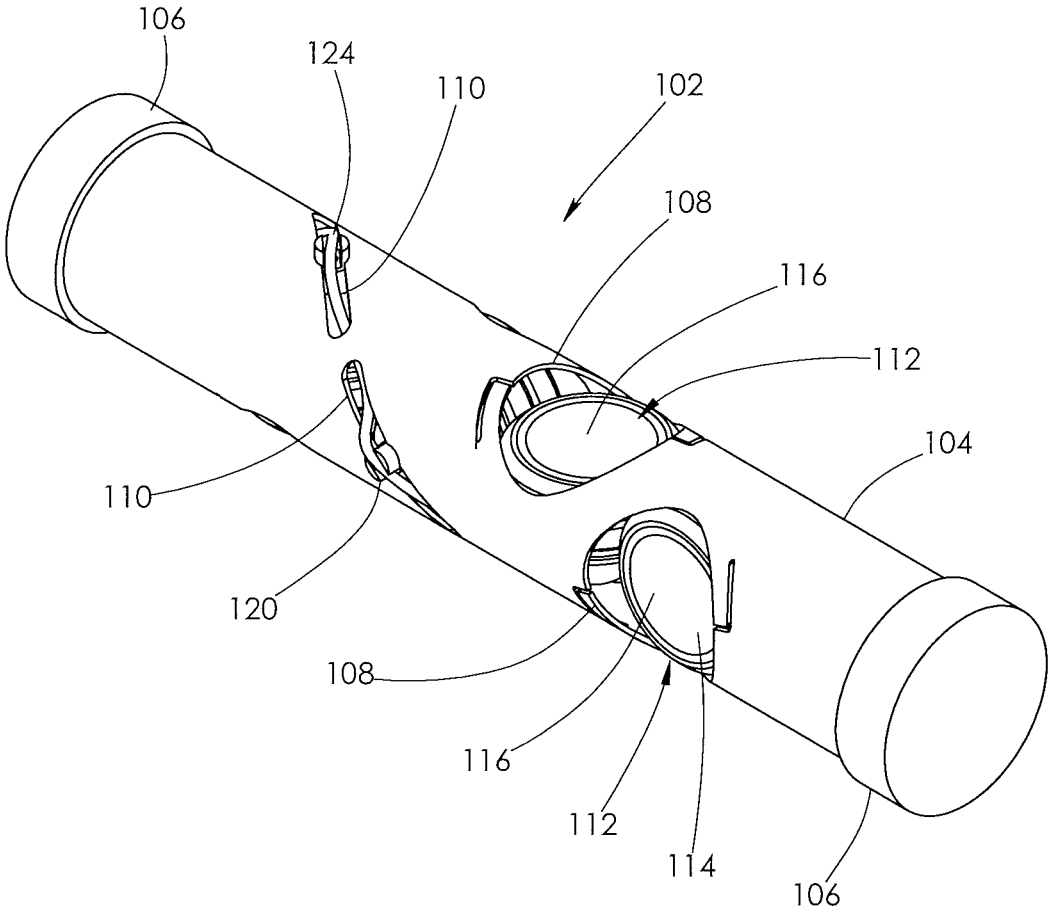
FIG. 12 is a perspective view of the charge housing shown in FIG. 11.

Turning to FIGS. 11 and 12, an alternative embodiment of a perforating gun 100 is shown. The gun 100 comprises a charge housing 102 disposed within a sleeve 103. The sleeve 103 is identical to the sleeve 26 shown in FIGS. 2 and 3. The charge housing 102 comprises an elongate tube 104 sealed on each end by an end cap 106. The tube 104 and end caps 106 are preferably made of ceramic or other non-metallic solid material. A plurality of openings 108 are formed in the tube 104 along its length. Each opening 108 is positioned at a non-zero angle relative to its adjacent opening 108. Preferably, each of the openings 108 is positioned at a 90 degree angle relative to its adjacent opening 108.

A plurality of angled slits 110 are also formed in the tube 104. Each slit 110 is formed opposite each opening 108 in a one-to-one relationship. The slits 110 are aligned and spaced from one another so as to form a path around the tube 104, as shown in FIG. 12.

Figure 13:
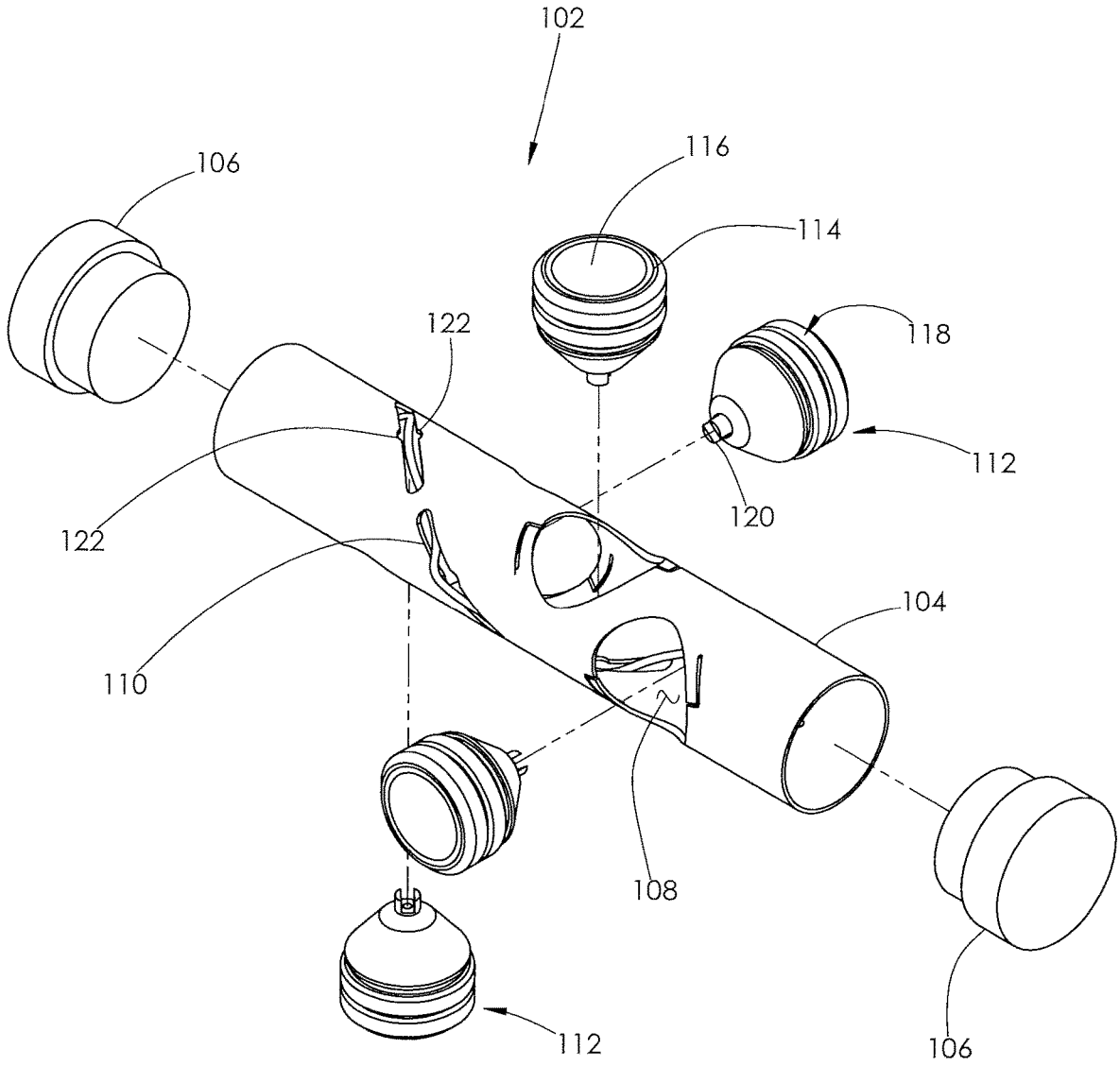
FIG. 13 is an exploded view of the charge housing shown in FIG. 12.

Continuing with FIGS. 12-15, a plurality of shaped charges 112 are housed within the tube 104. The shaped charges 112 are identical to the shaped charges 54, shown in FIGS. 5 and 6. The shaped charges 112 may be installed within the tube 104 through each of the openings 108 or through the open ends of the tube 104. Each of the shaped charges 112 is installed so that its top surface 114 aligns with one of the openings 108 in a one-to-one relationship, as shown in FIG. 12. Each of the openings 108 is sized to fully expose the explosive material 116 contained within a lens 118. The shaped charges 112 are also installed so that each connection point 120 passes through a corresponding one of the slits 110. A set of notches 122 may be formed in each of the slits 110 to provide space for the connection point 120, as shown in FIG. 13.

When the shaped charges 112 are installed within the tube 104, each of the charges 112 faces a different direction. Such positioning allows the gun 100 to perforate multiple areas of the casing 16 when the charges 112 are detonated.

The embodiment of the charge housing 102 shown in FIGS. 12 and 13 includes four shaped charges 112 and four corresponding openings 108 and slits 110. In alternative embodiments, the charge housing may include more or less than four charges, openings, and slits. The tube may also be configured so that the shaped charges are positioned at any angle desired relative to one another.

Figure 14:
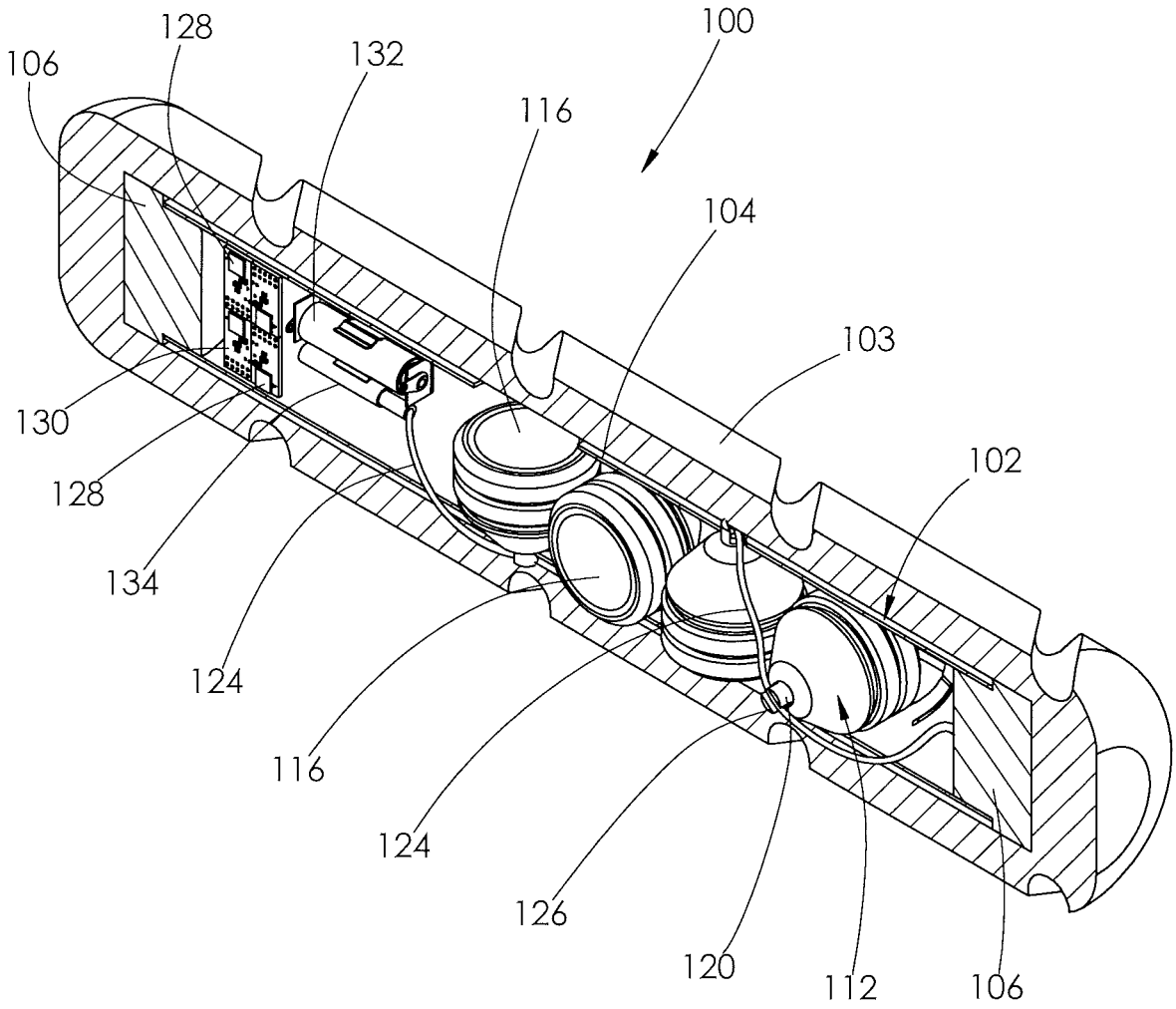
FIG. 14 is a perspective sectional view of the gun shown in FIG. 11, exposing the inner components of the charge housing.
Figure 15:
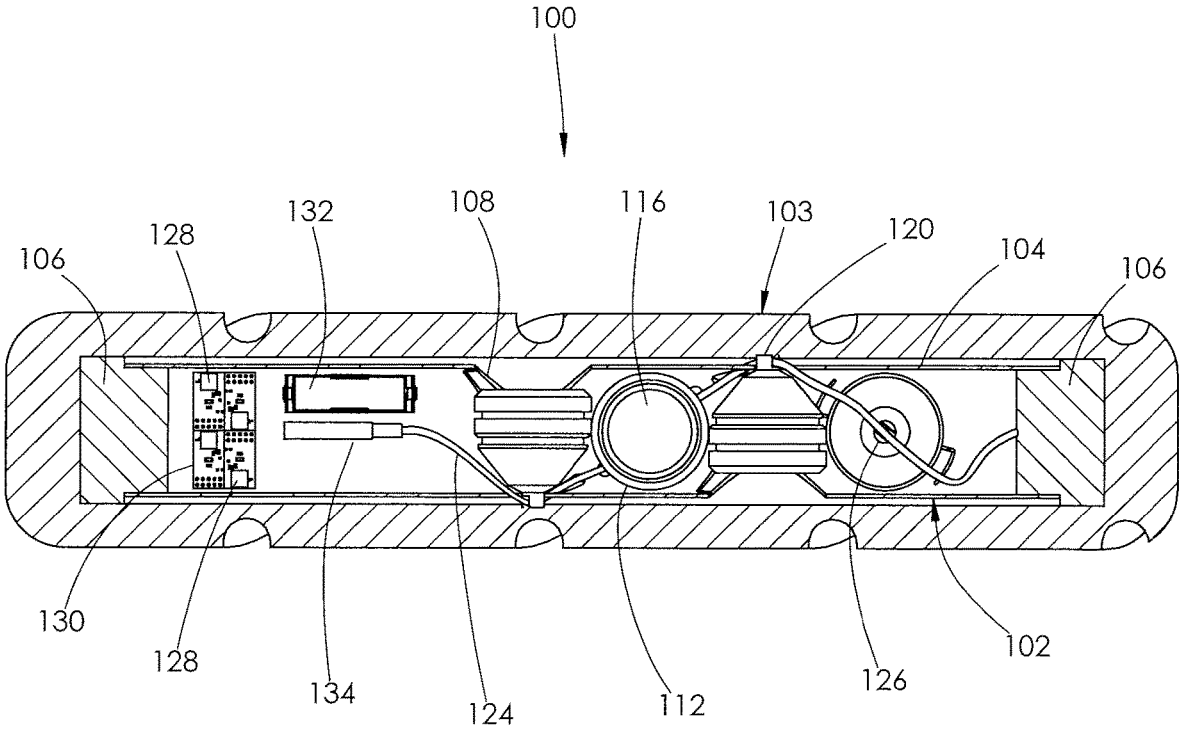
FIG. 15 is a top plan view of the gun shown in FIG. 14.

With reference to FIGS. 14 and 15, a detonation cord 124 is installed within the tube 104 that engages with each of the shaped charges 112. The cord 124 is identical to the cord 70 shown in FIGS. 5 and 6. The cord 124 is routed along the path created by the slits 110, as shown in FIG. 12. When installed in the tube 104, the cord 124 passes at least partially through each of the slits 110 and is positioned within a slot 126 formed in each of the connection points 120, as shown in FIGS. 12 and 14.

The perforating gun 100 also includes one or more sensors 128 supported on an electronic board 130, a battery 132, and a detonator 134. Such components are identical to those described with reference to FIGS. 5 and 6. The gun 100 operates in the same manner as the gun 22.

Turning to FIG. 16, another alternative embodiment of a perforating gun 200 is shown. The gun 200 comprises a charge housing 202 disposed within a sleeve 203. The sleeve 203 is identical to the sleeve 26 shown in FIGS. 2 and 3. The charge housing 202 is identical to the charge housing 102 shown in FIGS. 12 and 13, with the exception of the size of a plurality of openings 204 formed in its tube 206. The openings 204 are sized to only expose a portion of an explosive material 208 included in each shaped charge 210. Decreasing the size of the openings 204 ensures that the explosive charges 210 impact at least a portion of the tube 206 upon detonation. Such impact helps break the charge housing 202 and sleeve 203 into a plurality of pieces during operation.

Figure 17:
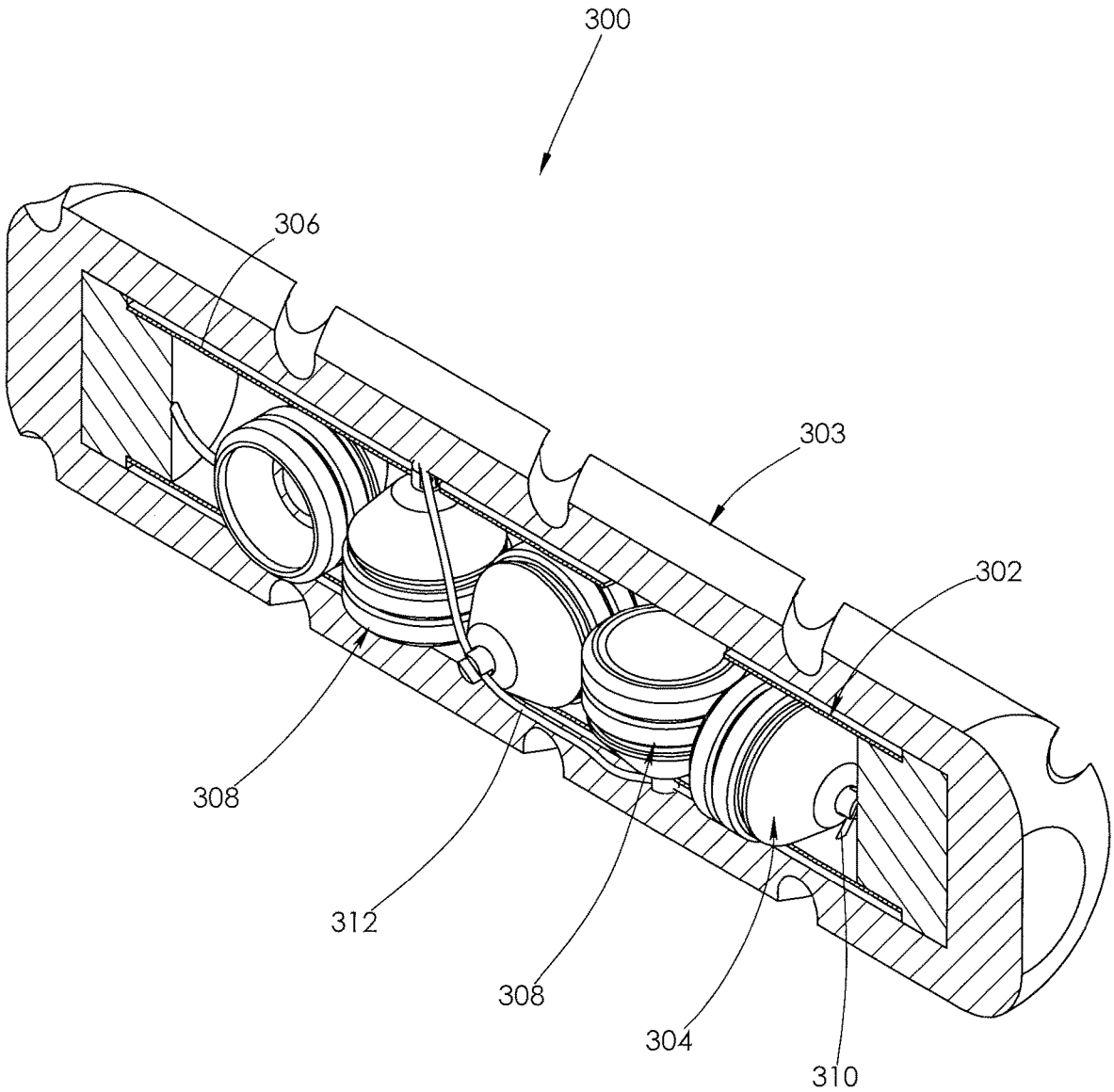
FIG. 17 is a sectional view of another embodiment of a perforating gun, exposing another embodiment of a charge housing.

Turning to FIG. 17, another embodiment of a perforating gun 300 is shown. The gun 300 comprises a charge housing 302 disposed within a sleeve 303. The sleeve 303 is identical to the sleeve 26 shown in FIGS. 2 and 3. The charge housing 302 is identical to the charge housing 102 shown in FIGS. 12 and 13, except that an uphole facing shaped charge 304 has been included in its tube 306. Rather than facing outwards towards the walls of the casing 16, the shaped charge 304 faces a longitudinal axis of the gun 300 and the other charges 308. The shaped charge 304 is also positioned at a terminal end 310 of the detonation cord 312.

During operation, the shaped charge 304 will be the last charge ignited by the detonation cord 312. Upon detonation, the shaped charge 304 will explode outwards along the longitudinal axis of the gun 300, helping to break the gun 300 into the plurality of pieces 86, shown in FIG. 9. An uphole facing shaped charge 304 may also be used with the gun 22 or 200 shown in FIGS. 3 and 16. In alternative embodiments, a plurality of uphole facing shaped charges may be included in the charge housing.

While not shown, the perforating guns 200 and 300 also include the one or more sensors, electronic board, battery, and detonator described with reference to FIGS. 5 and 6. The perforating guns 200 and 300 are operated in the same manner as the gun 22.

A kit is useful for assembling the gun 22, 100, 200, or 300. The kit may comprise the sleeve 26, 103, 203, or 303 and the charge housing 24, 102, 202, or 302. The kit may further comprise the plurality of shaped charges 54, 112, 210, 304, or 308, the detonation cord 70, 124, or 312, the detonator 76 or 134, the battery 78 or 132, the electronic board 74 or 130, and the one or more sensors 72 or 128.

Changes may be made in the construction, operation and arrangement of the various parts, elements, steps and procedures described herein without departing from the spirit and scope of the invention as described in the following claims.

The invention claimed is:

1. A method of using a tool in an environment, the tool comprising:

an elongate body carrying a plurality of explosive charges, in which the elongate body is installed within a removable sleeve, and in which a helical groove is formed in an outer surface of the sleeve;

a collar counter in communication with the plurality of explosive charges, in which the collar counter is configured to initiate a detonation sequence of the plurality of explosive charges, and in which the collar counter is configured by external input on an interface, the interface configured to communicate wirelessly with the collar counter;

the environment comprising:

a wellbore formed within the ground and having a casing installed therein, in which the casing comprises a plurality of collars; and in which the wellbore comprises a horizontal section;

the method comprising:

configuring the collar counter to initiate the detonation sequence of the plurality of explosive charges once the collar counter counts a specified number of collars within the casing as the tool is lowered into the horizontal section of the wellbore; and lowering the tool into the horizontal section of the wellbore using only fluid.

2. The method of claim 1 in which a wireline is not attached to the tool as it is lowered into the horizontal section of the wellbore.

3. The method of claim 1, further comprising:

detonating the plurality of explosive charges; and fragmenting the tool into a plurality of pieces.

4. The method of claim 1, further comprising:

detonating the plurality of explosive charges;

thereafter, increasing fluid pressure within the casing; and fragmenting the tool into a plurality of pieces.

5. The method claim 1 in which the sleeve is made of a foam material.

* * * * *